US005105640A

United States Patent [19]

Moore

[11] Patent Number: 5,105,640

[45] Date of Patent: Apr. 21, 1992

[54] METHOD AND APPARATUS FOR FORMING BOX-SHAPED SHEET METAL DUCTS

[75] Inventor: Cecil E. Moore, Solon, Iowa

[73] Assignee: Iowa Precision Industries, Inc., Cedar Rapids, Iowa

[21] Appl. No.: 646,069

[22] Filed: Jan. 25, 1991

[51] Int. Cl.[5] ..... B21D 39/02

[52] U.S. Cl. ..... 72/51; 72/306; 72/319

[58] Field of Search ..... 72/51, 52, 306, 307, 72/384, 379.2, 319, 368; 228/173.6, 150, 137

[56] References Cited

U.S. PATENT DOCUMENTS

| | | | |
|---|---|---|---|
| 2,159,784 | 5/1939 | Demmin | 72/306 |
| 3,269,164 | 8/1963 | Rutter | 72/306 |
| 3,726,120 | 4/1973 | Hugert | 72/306 |
| 4,043,165 | 8/1977 | Badger et al. | 72/307 |
| 4,803,879 | 2/1989 | Crawford | 72/306 |

FOREIGN PATENT DOCUMENTS 0265341 3/1989 German Democratic Rep. ... 72/319

*Primary Examiner*—Lowell A. Larson
*Assistant Examiner*—Michael J. McKeon
*Attorney, Agent, or Firm*—James C. Nemmers

[57] ABSTRACT

An improved method and apparatus for forming box-shaped sheet metal ducts with Pittsburgh-type seams. The improved method is a continuous process in which the sheet metal is fed from an uncoiler, and after straightening and notching, the leading edge is fed into a single apparatus that performs all of the remaining forming functions. In this single apparatus, the leading edge of the material is formed into the male portion of the Pittsburgh seam, after which the box is formed and then the female portion of the Pittsburgh seam is formed and the material sheared to complete the box section. Using this improved method eliminates the moving of separate parts from one station to another, thereby improving the efficiency of the forming operation and the quality of the resulting box section.

5 Claims, 3 Drawing Sheets

FIG. 3 (PAGE 1 OF FIG. 3)
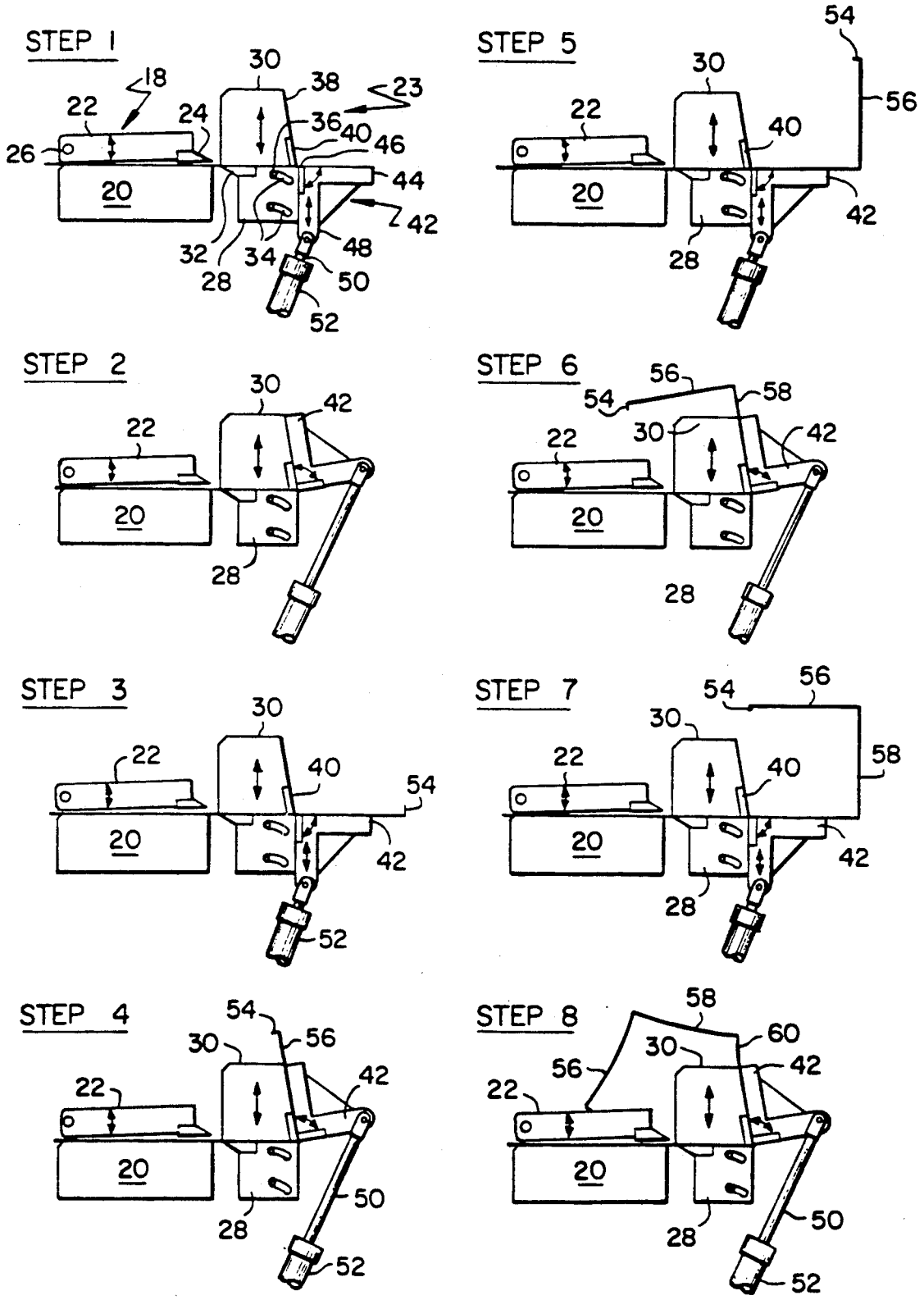

FIG. 3 (PAGE 2 OF FIG. 3)
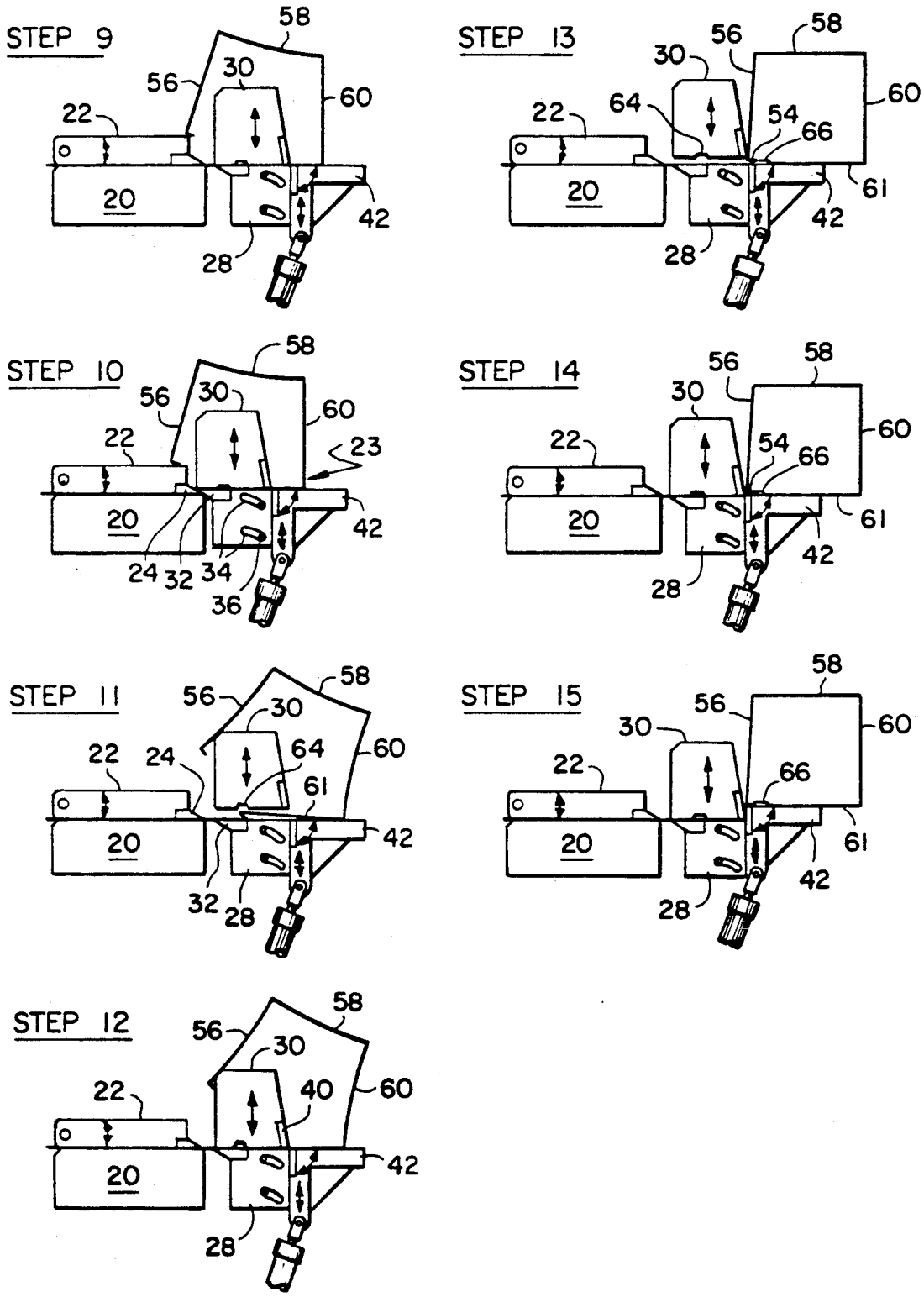

METHOD AND APPARATUS FOR FORMING BOX-SHAPED SHEET METAL DUCTS

BACKGROUND OF THE INVENTION

Box-shaped ducts are extensively used in heating and ventilating systems to distribute heated or cooled air throughout a structure. The ducts are commonly formed in sections of predetermined length which are then connected to form a continuous air distribution duct. The material from which the duct sections are formed is sheet metal of the desired gauge fed from a roll or coil of material. As the sheet metal uncoils, it is flattened or straightened to remove the curved set in the material that exists from it being coiled. The sheet metal is then notched along its side edges at predetermined distances where the corners of the duct section will be formed. A shear then cuts the material into blanks of a length necessary to form a finished duct section. This notched blank is then moved 90 degrees onto a roll former to form the male and female portions of the Pittsburgh seam at the opposite ends of the blank. The blank is then transferred once again, usually 90 degrees, into a roll former to form the flanges that will provide for connection of the individual duct sections. When the flanges have been formed, the blank is then transferred to a sheet metal break where three 90 degree bends are made to form the box-shaped section. Obviously, this process involves the repeated handling of individual pieces and the transfer of them from one machine to another throughout the forming process. It is not only time consuming to transfer these blanks from machine to machine, but it requires a considerable amount of floor space for the equipment, conveyors and transfer tables between the pieces of equipment. Moreover, roll forming of the male and female portions that form the Pittsburgh seam frequently distorts the sheet metal with the result that the seams are not straight making it more difficult to complete the duct section and lock the seam on the job site when the sections are and assembled into a continuous air distribution duct.

There is therefore a need for an improved method and apparatus for forming box-shaped duct sections with male and female Pittsburgh seams.

To fulfill the foregoing need, it is an object of the invention to provide an improved method and apparatus which will minimize the amount of floor space required to carry out the complete forming process.

It is a further object of the invention to provide an improved method and apparatus that will provide for forming the box-shaped duct sections more quickly and efficiently and at a lower cost.

The improved method and apparatus of the invention fulfills all of the foregoing needs and objects while producing a product that is of an improved quality.

SUMMARY OF THE INVENTION

With the method and apparatus of the invention, after the sheet metal is uncoiled, straightened and notched, the leading edge of the material is fed into a single apparatus in which the male portion of the Pittsburgh seam is first formed, and then a first right angle bend is made, a second right angle bend and a third right angle bend. After completion of the bends, the female portion of the Pittsburgh seam is formed and the material sheared to complete the box-shaped section. All of the foregoing is performed in a single apparatus at a single station, and since it is a continuous process, there is no necessity to handle individual blanks or pieces. Obviously, with such a method and apparatus, there is a substantial reduction in the amount of production space required. Also, conveyors and transfer tables between machines are eliminated, and the resulting box section is not only more efficiently formed, but the Pittsburgh seam is not distorted resulting in easier final assembly of the duct section on the job site.

BRIEF DESCRIPTION OF THE DRAWING

FIG. 3 is a view showing in numbered sequence fifteen steps performed at the final station to complete the formation of the box-shaped duct.

DESCRIPTION OF THE PREFERRED EMBODIMENT OF THE INVENTION

Figure 1:
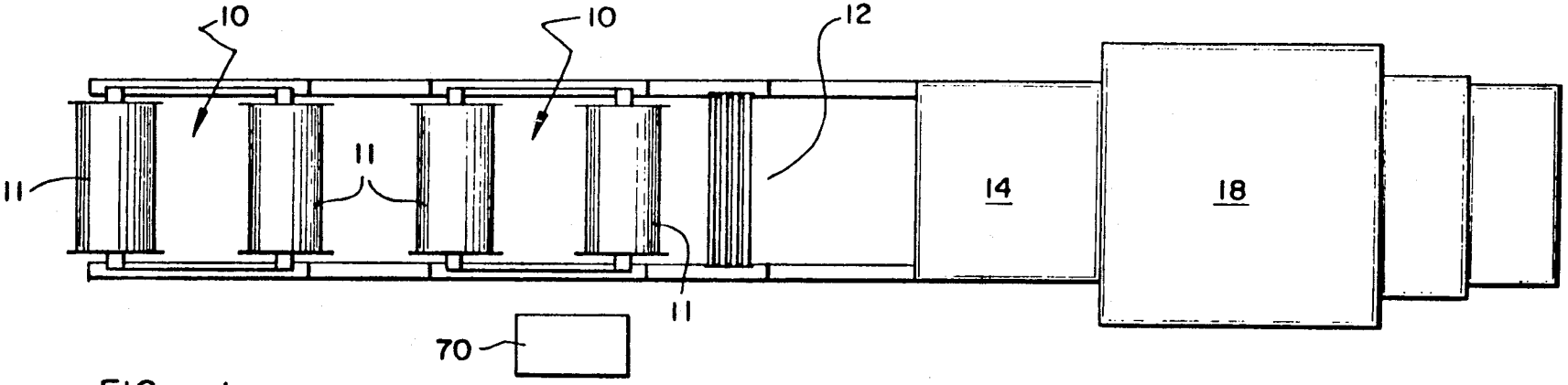
FIG. 1 is a top or plan view of a schematic diagram illustrating the line of equipment used to carry out the formation of a box-shaped duct according to the principles of the invention.
Figure 2:
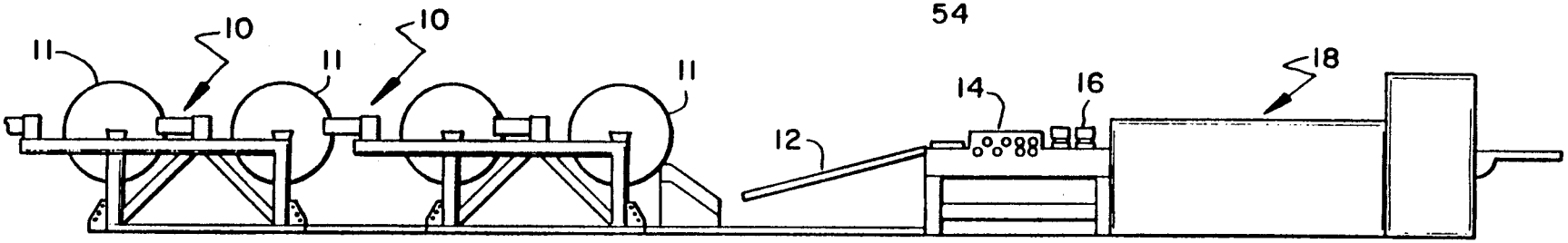
FIG. 2 is a side elevational view schematically showing the line of equipment for carrying out the method of the invention.

In FIGS. 1 and 2 there is illustrated schematically a system of equipment for producing box-shaped sheet metal duct sections from a coil of sheet metal of the desired gauge and width. As is well known to those skilled in the art, the width of the material determines the length of the completed duct section. FIGS. 1 and 2 illustrate the relatively small amount of floor space required in a production facility in order to produce the box sections using the principles of the invention.

As illustrated in FIGS. 1 and 2, sheet metal of the desired gauge and width is commonly supplied in large rolls or coils 11 which are placed in uncoilers 10 at the start of the production line. The drawings illustrate four such uncoilers to assure minimum interruption of the production when the material from one of the coils 11 is completely used. As is well known to those skilled in the art, the sheet metal material from one of the coils 11 is fed by a feeder 12 into an apparatus 14 that contains a plurality of rolls that will remove the set in the material caused by it being wound on a coil 11. The apparatus 14 thus straightens the material, and notchers 16 are programed to notch the side edges of the material at predetermined distances where the material will ultimately be bent to form the box-shaped duct section. In other words, the distance between the notches will correspond to the dimensions of the finished duct section. Also, it will be understood that the width of the material determines the approximate length of the finished duct section. In some instances, once the material is notched by notchers 16, the material from the side edges to a line through the apex of each notch is bent downwardly by roll formers to form flanges which are used to connect the individual sections of the box-shaped ducts, as is well known to those skilled in the art. It will be understood that the principles of the invention are applicable to forming box-shaped duct sections regardless of whether these flanges are formed or not.

After the material is straightened and then notched by apparatus 14, it is continuously fed into the forming apparatus of the invention, indicated generally by the reference numeral 18, which apparatus is illustrated in FIG. 3 and described more fully hereinafter.

Referring now to FIG. 3, there are shown fifteen steps that occur during the formation of a box-shaped duct section from the notched and straightened material. The fifteen views of FIG. 3 are each a side elevational view showing the components of the apparatus in the relative positions when performing a particular step of the method. The apparatus as illustrated in FIG. 3 includes a stationery table 20 above which there is pivotally mounted a clamping beam 22 having a somewhat V-shaped die 24 positioned at the downstream end. As shown, the clamping beam 22 is pivoted about pivot point 26 at the upstream end of the beam 22. The material to be formed is fed between the table 20 and the beam 22 from left to right in FIG. 3.

Spaced downstream from and supported independently of the table 20 and beam 22 is a forming unit 23 that includes a lower moveable forming table 28 and a vertically moveable forming beam 30. The forming table 28 has a V-shaped die 32 at its upstream end, and movement of the table 28 is along an arcuate path defined by slots 34 which engage fixed supports 36. Thus, movement of table 28 will always be along the arcuate path defined by the curvature of the slots 34. The upper forming beam 30 is supported in any suitable manner, such as on cables (not shown), that permit movement of the beam 30 with the forming table 28 when the table 28 moves in the arcuate path defined by slots 34, but forming beam 30 also is moveable vertically independently of the forming table 28.

The downstream side 38 of beam 30 is a flat and straight surface which is at a slight angle to the vertical as shown in the drawings, and at the lower end of side 38 is a straight edge 40 extending transversely across the direction of travel of the material.

The forming unit 23 also includes an L-shaped bending beam 42, the horizontal leg 44 of which normally is on a level with the table 28. The horizontal leg 44 also includes at its downstream end a straight edge 46 extending transversely of the direction of movement of the material. The beam 42 is moveable as a part of the forming unit 23 but is also moveable independently of unit 23. In its normal position, beam 42 is positioned with the edge 46 just beneath and slightly ahead of the edge 40 of table 20 so that leg 44 becomes an extension of the forming table 28. To provide for independent movement, beam 42 has a vertical leg 48 to which there is pivotally attached the operating rod 50 of a hydraulic cylinder 52. By operation of the hydraulic cylinder 52, the bending beam 42 is capable of independent vertical and pivotal movement as described hereinafter.

Figure 4:
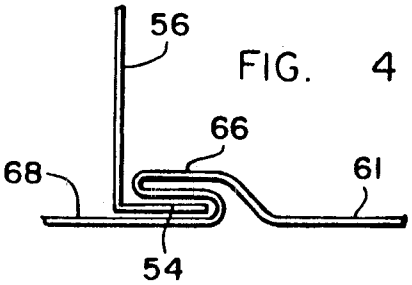
FIG. 4 is a view illustrating the standard Pittsburgh type seam.

Referring now to Step 1 of FIG. 3, the sheet metal material is fed over table 20 and beneath the raised clamping beam 22 and in between the forming table 28 and forming beam 30. The leading edge of the material is fed beyond the edge 40 the desired distance of the male portion of the standard Pittsburgh seam, and the material is then clamped and held between the table 28 and beam 30. As is shown in FIG. 4, a standard Pittsburgh seam has a male portion indicated by the reference numeral 54, this portion being formed by bending over a predetermined amount of the material at an angle of approximately 90 degrees.

Step 2 of FIG. 3 illustrates formation of the male portion 54. While the material is clamped between the forming table 28 and forming beam 30, the bending beam 42 is pivoted through an arc slightly greater than 90 degrees to bend the edge of the material against the surface of side 38 to thereby form the male portion 54. The bend is slightly in excess of 90 degrees to allow for the normal spring-back of the material. As illustrated in Step 3 of FIG. 3, the result is the formation of the male portion 52 which extends upwardly from the general plane of the material.

Step 3 of FIG. 3 illustrates the bending beam 42 returned to its normal position with the material advanced beyond the edge 40 the desired distance of the first side 56 of the box-shaped duct section. Step 3 also shows the material clamped and held between the forming table 28 and beam 30, it being understood that each time material is to be advanced the forming beam 30 is raised to permit the material to advance. It should be further understood that the clamping beam 22 is normally pivoted to an upward position, thus permitting the material to be advanced along the top of the table 20.

Step 4 illustrates movement of the bending beam 42 through an arc of greater than 90 degrees to bend the material against the side 38 of the forming beam 30 to form the first side 56 of the duct section. A sharp, precise bend is produced by reason of the straight edge 40. When the bending beam 42 is returned to its normal position, the resilience of the material will allow it to spring back so that it extends approximately 90 degrees from the plane of the material being fed into the apparatus, thus forming the first side 56 of the duct section.

In Step 5, there is illustrated the material being advanced beyond the edge 40 a distance equal to the dimension of the second side 58 of the duct section being formed. At Step 5, the material is shown as clamped and held between the forming table 28 and forming beam 30 and with the bending beam 42 in its normal position. Step 6 shows the bending beam 42 pivoted through an arc slightly larger than 90 degrees until the material is against the side 38 of the forming beam 30. When the bending beam 42 returns to its normal position, the material will once again spring back to form the second side 58 of the duct section.

The forming beam 30 is again raised slightly and the material advanced beyond the edge 40 a distance equal to the dimension of the third side 60 of the duct section after which the forming beam 30 is lowered against the material to clamp it and hold it between the beam 30 and table 28. Step 8 illustrates movement of the bending beam 42 through an arc until the material once again is pressed against the side 38 of beam 30, and upon release of the bending beam 42, the material will spring back to approximately 90 degrees, thus forming the third side 60. Note that the dimensions of the forming beam 30 are such to permit the sides 56, 58 and 60 to move over the top of the beam 30 without interference.

The remaining steps of the method performed by the apparatus 18 relate to the formation of the female portion 66 of the Pittsburgh seam. In Step 9, the material is once again advanced a predetermined distance beyond the edges of the V-shaped dies 24 and 32, which will form a "Z" in the material as a preliminary to formation of the female portion 66 of the Pittsburgh seam. Step 9 shows the material having been advanced and then clamped between the forming table 28 and forming beam 30 and also between the table 20 and the beam 22. Note that in this position, there is a gap between the edges of the dies 24 and 30 with the material extending across this gap. FIG. 10 shows the movement of the entire unit 23, consisting of the forming table 28, forming beam 30 and bending beam 42, upwardly and upstream so that the die 32 is now positioned above the die 24. Movement of the unit 23 is determined by slots 34 as previously described. When the unit 23 is returned to its normal position as illustrated in Step 11, it will be seen that a "Z" shaped bend is formed transversely across the material. Step 11 shows the forming beam 30 raised and the material advanced so that the "Z" is positioned beneath a cavity 64 formed in the bottom surface of beam 30, which cavity 64 extends transversely across the forming beam 30. Step 12 shows the forming beam 30 lowered to squeeze the "Z" into the cavity 64 thereby forming the female portion 66 (see FIG. 4) of the Pittsburgh seam.

Step 13 shows the forming beam 30 raised to allow release of the female portion 66 from the cavity 64 as the material is again advanced a predetermined distance beyond the edge 40. This distance will be an amount sufficient to form the offset portion 68 of the Pittsburgh seam. Unlike some prior art methods, this distance is not critical, although the method of the invention provides for reasonably close tolerance if desired. As is well known to those skilled in the art, this offset portion is that portion which will extend beyond side 56 after the male portion 54 is inserted into the female portion 66, which offset portion 68 is then bent 90 degrees over the side 56 to complete the seam and lock the portions together. Step 14 of FIG. 3 illustrates the forming beam 30 lowered to clamp and hold the material and with the clamping beam 22 also pivoted downwardly to hold the material in place. Step 15 shows the bending beam 42 moved vertically so that the straight edge 46 passes by the straight edge 40 to shear the material, thus completing the duct section and separating it from the material. Although not shown in FIG. 3, the bending beam 42 is then returned to its normal position and the process commenced again at Step 1 in which the clamping beam 22 is raised and the material advanced as previously described.

The foregoing described method and apparatus provides for a continuous process in which it is never necessary to transport loose parts until the box-shaped duct section is completely formed. Until that time, the material is fed from the coil in steps with the amount of feed being predetermined by appropriate controls that control not only the amount advanced, but the time during and between the described steps while also controlling movement of the various forming components of the apparatus. This can all be performed from a console 70 containing all of the necessary controls operable by a single operator. Obviously, the entire process can be automated by appropriate program controls, thus minimizing the involvement of an operator.

It will be evident to those familiar with the present prior art methods of forming box-shaped ducts, that the method and apparatus of the invention minimizes distortion of the material that sometimes is caused during the prior art roll forming process. Using the method and apparatus of the invention, the male portion 54 and female portion 66 are formed within predetermined tolerances without distortion, thus making it easier to assemble the duct section when it is installed on the job site. The quality of the duct section is comparable to any sheet metal part formed on sheet metal breaks. Because the apparatus and method of the invention eliminate transfer of loose parts between stations, the cost of the equipment necessary to perform the whole process is greatly reduced, and the amount of space required to perform the process is substantially reduced. The method and apparatus of the invention also is useable for forming box sections with Pittsburgh seams regardless of whether the box sections have flanges. In other words, roll forming of flanges along the outer edges of the sheet material do not in any way interfere with performance of the various steps of the invention. Use of the method and apparatus of the invention thus substantially reduces the cost of producing box-shaped duct sections while still producing a product of better quality than that produced by prior art methods. The labor saving and saving in fixed costs by reason of substantial space reduction required to perform the process is very attractive to producers of sheet box sections.

Having thus described the invention in connection with the preferred embodiment thereof, it will be evident to those skilled in the art that various revisions and modifications can be made to the embodiment described herein without departing from the spirit and scope of the invention. It is my intention however that all such revisions and modifications as are obvious to those skilled in the art will be included within the scope of the following claims.

What is claimed is as follows:

1. A method of continuously forming from a strip of bendable sheet material having side edges and a leading edge a box-shaped duct section that has female and male portions of a Pittsburgh type seam, said method comprising the steps of: bending the leading edge of the material at a right angle to form the male portion of the Pittsburgh seam; advancing the material to a first point that is a distance from the male portion approximately the dimension of a first side of the duct section; bending the material at that point through a right angle to from the first side of the duct section; advancing the material to a second point that is a distance from the first side approximately the dimension of a second side of the duct section; bending the material at said second point through approximately a right angle to form the second side of the duct section; advancing the material to a third point that is a distance from the second side approximately the dimension of a third side of the duct; bending the material at said third point through approximately a right angle to form the third side and the fourth side of the duct section; advancing the material a predetermined distance along the fourth side where the female portion of the Pittsburgh seam is to be located; forming two spaced apart bends of opposite acute angles in the material of the fourth side so that the material at the bends overlaps itself in a "Z" configuration; compressing the "Z" to form the female portion of the Pittsburgh seam; and advancing the material a predetermined distance along the fourth side and cutting the material along the fourth side at a distance downstream from the female portion to complete the duct section and to form an offset portion for locking the Pittsburgh seam when the duct section is assembled.

2. The method of claim 1 in which each of the right angle bends of the material is through an angle greater than 90 degrees to allow for the material to spring back to an angle of 90 degrees after the bend is complete.

3. The method of claim 1 in which prior to performing any of the bends in the material there are formed notches in the side edges of the material at the points where the material is to be bent.

4. The method of claim 1 in which the material from which the duct sections are to be formed is a continuous strip of material.

5. An apparatus for continuously forming from a strip of bendable sheet material having side edges and a leading edge a box-shaped duct section that has female and male portions of a Pittsburgh type seam, said apparatus comprising: a stationary table having an upper surface over which the material passes; a clamping beam mounted for movement toward and away from the upper surface of the stationary table to intermittently hold the material passing between the upper surface of the stationary table and the clamping beam; means for controllably advancing the material predetermined distances at selected intervals so that the material is held between the stationary table and the clamping beam after advancement and during the time the material is being formed; a forming table downstream from the stationary table and having an upper surface over which the material passes; means for controllably moving the forming table from a first position with its upper surface in substantially the same plane as the upper surface of the stationary table to a second position closer to the stationary table and with its upper surface above the upper surface of the stationary table; a forming beam positioned above the upper surface of the forming table and moveable vertically toward and away from said upper surface; a pivotally moveable bending beam downstream from the forming table and positioned adjacent to the forming table; means for pivoting the bending beam from a first position beneath material passing over the upper surface of the forming table to a second position in which the material is bent at approximately a right angle so as to form a corner of the duct section; a first forming die combined with the stationary table and a second forming die combined with the moveable forming table; the first and second forming dies providing for forming two spaced apart bends of opposite acute angles in the material so that the material at the bends overlaps itself in a "Z" configuration when the moveable forming table is moved from its first position to its second position; means for moving the forming beam toward the forming table so as to compress the "Z" in the material thereby to form the female portion of a Pittsburgh seam; and means for moving the bending beam vertically relative to the forming table so as to cut the material at a distance beyond the female portion to form an offset portion for locking the Pittsburgh seam when the duct section is assembled.

* * * * *